US012313260B2

(12) United States Patent
Hay et al.

(10) Patent No.: US 12,313,260 B2
(45) Date of Patent: May 27, 2025

(54) RADIANT HEAT OR THERMAL BASED FLARE EFFICIENCY MONITORING

(71) Applicant: Schlumberger Technology Corporation, Sugar Land, TX (US)

(72) Inventors: Glen Andrew Hay, Calgary (CA); Andrew Emil Pomerantz, Lexington, MA (US); Athithan Dharmaratnam, Abingdon (GB); Karl Staffan Tekin Eriksson, Abingdon (GB); Andrew J. Speck, Milton, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 326 days.

(21) Appl. No.: 17/663,554

(22) Filed: May 16, 2022

(65) Prior Publication Data

US 2023/0366543 A1 Nov. 16, 2023

(51) Int. Cl.

| | |
|---|---|
| ***F23N 5/10*** | (2006.01) |
| ***F23N 5/08*** | (2006.01) |
| ***F23N 5/26*** | (2006.01) |

(52) U.S. Cl.

CPC ..... *F23N 5/102* (2013.01); *F23N 5/082* (2013.01); *F23N 5/265* (2013.01); *F23N 2229/20* (2020.01); *F23N 2239/04* (2020.01); *F23N 2239/06* (2020.01); *F23N 2900/05005* (2013.01)

(58) Field of Classification Search

CPC ... F23N 5/082; F23N 2239/06; F23N 2239/04

USPC ..... 431/22, 202

See application file for complete search history.

(56) References Cited

U.S. PATENT DOCUMENTS

| | | | | |
|---|---|---|---|---|
| 7,876,229 | B2 | 1/2011 | Rao | |
| 8,138,927 | B2 | 3/2012 | Diepenbroek | |
| 10,041,673 | B2 | 8/2018 | Pathangay | |
| 10,078,328 | B1 * | 9/2018 | Slater | B64G 99/00 |
| 10,920,982 | B2 | 2/2021 | Arabi | |
| 11,248,963 | B2 | 2/2022 | Kraus | |
| 2008/0233523 | A1 * | 9/2008 | Diepenbroek | F23G 5/50 431/14 |

(Continued)

FOREIGN PATENT DOCUMENTS

| | | | |
|---|---|---|---|
| EP | 2309186 | A2 | 4/2011 |
| EP | 1528793 | B1 | 1/2012 |

(Continued)

OTHER PUBLICATIONS

Olson, Walter. Bernando, Ceveland. Temperature Measurements and Combustion Efficiency in Combustor for Gas-Turbine Engines. Transactions of the ASME. May 1948 (Year: 1948).*

(Continued)

*Primary Examiner* — Vivek K Shirsat

(74) *Attorney, Agent, or Firm* — Jeffrey D. Frantz

(57) ABSTRACT

Systems and methods presented herein generally relate to determining flaring efficiency of a flare based at least in part on radiant or thermal heat generated by the flare that is detected by one or more flare monitors. In particular, in certain embodiments, a control system may be used to determine a flaring efficiency of the combustion of the flare gas at the tip of the flare based at least in part on the radiant or thermal heat detected by the one or more flare monitors.

14 Claims, 10 Drawing Sheets

(56) References Cited

U.S. PATENT DOCUMENTS

| | | | | |
|---|---|---|---|---|
| 2011/0085030 | A1 | 4/2011 | Poe et al. | |
| 2011/0195364 | A1* | 8/2011 | Tullos | F23G 5/50 431/75 |
| 2018/0209853 | A1* | 7/2018 | Kraus | G01N 21/72 |

FOREIGN PATENT DOCUMENTS

| | | | |
|---|---|---|---|
| WO | 2021066669 | A1 | 4/2021 |
| WO | 2021141749 | A1 | 7/2021 |

OTHER PUBLICATIONS

Flare.IQ, Complete plug-and-play solution to meet RSR 63.670 compliance, GE Pananmetrics-flareiq (2017) 2 pages.
FogHorn—FogHorn Lightning Flare Solution (ibm.com), downloaded on Sep. 7, 2022 (5 pages).
VISR Flare Monitoring | Providence Photonics, downloaded on Sep. 7, 2022 (3 pages).

* cited by examiner

RADIANT HEAT OR THERMAL BASED FLARE EFFICIENCY MONITORING

BACKGROUND

The present disclosure generally relates to systems and methods for determining flaring efficiency of a flare based at least in part on radiant or thermal heat generated by the flare that is detected by one or more flare monitors.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Many flares around the world are burning with no real certainty of the efficiency at which the liquid or gas is being fully combusted to carbon dioxide and water. Companies around the world are recognizing the need for emission tracking and determining the impact of greenhouse gas of non-combusted flare gas such as methane. Monitoring of the performance of a flare becomes essential in order to recognize or optimize the combustion (or destruction) efficiency. Simulated digital solutions on their own allow for an approximate ideal predicted value, but differences in manufacturer's designs and general non-idealities makes such solutions only theoretical.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a flare monitoring system may include a flaring system of an oil and gas worksite that includes a flare configured to combust a flare gas at a tip of the flare. The flare monitoring system may also include one or more flare monitors configured to detect radiant or thermal heat generated by the combustion of the flare gas at the tip of the flare. In addition, the flare monitoring system may further include a control system configured to determine a flaring efficiency of the combustion of the flare gas at the tip of the flare based at least in part on the detected radiant or thermal heat.

Certain embodiments of the present disclosure also include a method that may include detecting, via one or more flare monitors, radiant or thermal heat generated by combustion of a flare gas at a tip of a flare of a flaring system of an oil and gas worksite. The method may also include determining, via a control system, a flaring efficiency of the combustion of the flare gas at the tip of the flare based at least in part on the detected radiant or thermal heat.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
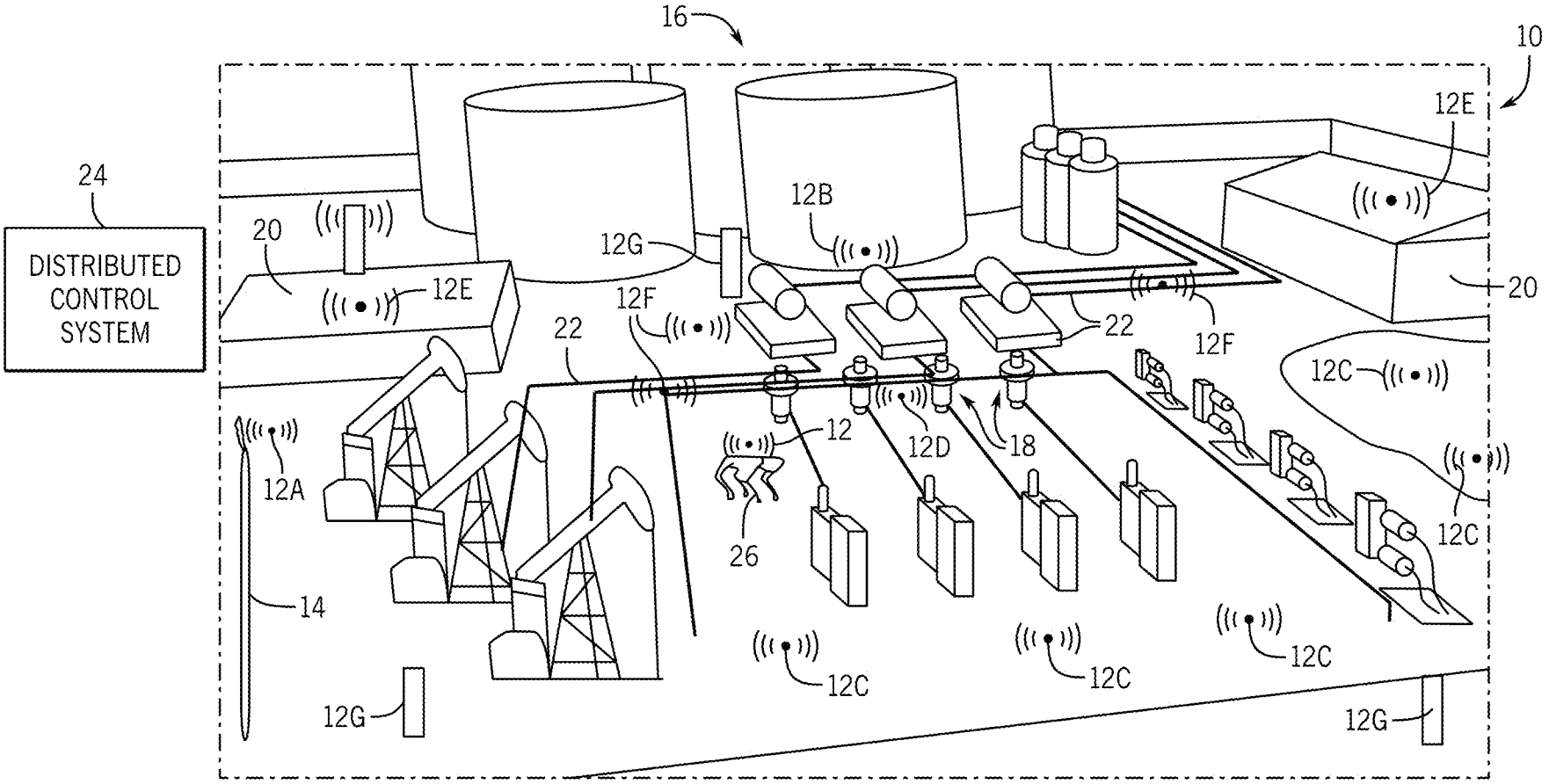
FIG. 1 illustrates an example oil and gas worksite that may include a plurality of sensors that may be used to monitor greenhouse gas emissions and/or gas emissions relating to flaring operations at an oil and gas worksite, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. More-over, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements."

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a greenhouse gas emission analysis system (i.e., solely by the greenhouse gas emission analysis system, without human intervention).

Systems and methods for simulating the performance of flares may include utilizing visual techniques such as red, green, blue (RGB), video imaging spectral radiometer (VISR), or light detection and ranging (LiDAR) applications, which may vary in costs. However, these applications may prove too expensive to deploy at a high number of flaring sites, thereby creating the need for a cheaper route of measurement. The embodiments described herein enable determination of flaring efficiency by means of radiant or thermal measurement, which can be deployed at a much more economical level for continuous flare monitoring validation.

In order to gather radiant heat or thermal measurements from a flare, ground, drone/plane, or satellite-based applications may be utilized. For any of these situations, a known flow rate and composition of fluids being combusted at any given point in time may also be known and cross-referenced with the radiant measurements to back-estimate flare efficiency. Usually, a bulk fluid going to a flare tip for combustion is not known directly, but instead is a collection of data related to: (1) flared gas flow and calorific value: the vented gas gathered from an upstream process or application, (2) steam or air assist flows: higher pressure steam or air that it used to help with mixing and combustion, which is often introduced to the flared gas close to the burner tip, and/or (3) supplementary gas injection flow: a higher BTU gas that is usually added in situations when flared gas on its own does not contain enough calorific content for a clean burn on its own.

For back-calculated combustion efficiency, using the data mentioned above, the main method of determination is through heat of reaction. The heat release may be considered from the direct combustion of fluids to carbon dioxide and water. Any deviation away from this ideal heat release may then be attributed to lack of complete reaction and, thus, provide a method of flare efficiency estimation. For complex mixtures with non-hydrocarbon components (e.g., hydrogen sulfide, ammonia, and so forth) or heavier hydrocarbon species (e.g., propylene, benzene, and so forth), the expected overall heat of reaction is still easily calculated using the reactants enthalpy of formation. With an enthalpy of formation coming from a standard thermodynamic package, the scope of application becomes complete.

Certain solutions for monitoring flare efficiency are plug-and-play solutions using digitally simulated optimal solution that receives process measurement data on-line in substantially real-time from flow and feed gas compositional or calorific instrumentation at site. In addition, certain solutions use VISR measurements to estimate flaring efficiency. Using VISR allows a three-dimensional (3D) flame to be reduced to a two-dimensional (2D) image for a full representation by the solution. In addition, certain solutions, make use of visually interpreted data to estimate flaring efficiency. Certain of these solutions utilize an RGB camera that analyzes flare and smoke characteristics. In addition, certain of these solutions utilize LiDAR to collect more dedicated information regarding carbon dioxide and methane levels in the combusted vapors of the flare.

The embodiments described herein utilizes connection between radiant or thermal heat, which should theoretically be released based on different levels of combustion achieved. The most basic of the reaction equations related to the destruction of methane is given in Equation 1 for a reference at 298 K (e.g., negative heat of reaction ($\Delta H_{Rxn}$) related to the exothermic nature of giving off heat). If other reactants are present in the combusted flare gas, then other balances, such as Equation 2 for ethane, may be considered based on the individual species' molar flow contribution. It should also be noted that these species will also change the stoichiometry and, therefore, heat capacity of the produced vapor, which will have impact on the final flame temperature achieved.

$$CH_4+2O_2 \rightarrow CO_2+2H_2O \quad \Delta H_{Rxn}=-802.3 \text{ kJ/mol} \qquad \text{(Eq. 1)}$$

$$C_2H_6+3.5O_2 \rightarrow 2CO_2+3H_2O \quad \Delta H_{Rxn}=-1560 \text{ kJ/mol} \qquad \text{(Eq. 2)}$$

The energy released due to the combustion reactions achieved is then absorbed into the vapors, which results in a resulting higher temperature that considers the heat capacity of the overall gases produced. Any deviation away from this temperature that is not accounted for may then be assumed non-converted feed reactants.

In order to reduce the effort of developing rigorous calculations for this conversion balance, a simulation model was built as software representing the combustion reaction. The wide database of feed components available also improved the range of the overall application's scope. With temperature of the flame determined, the flare efficiency may be predicted with an iterative convergence on the fraction of feed gas combusted to match the simulated product gas temperature.

Furthermore, the embodiments described herein include a conversion method to account for the measurement locations of radiant heat away from the flare tip and bringing this to a single averaged value for efficiency evaluation. In doing this, there is also use of a redundant heat measurement, when possible, that is shielded from the flare's flame. This redundant measurement allows for ambient influences of solar or air temperature to be accounted for within the calculations. In the situation of measurements from satellite, this redundant measurement may not be possible, and overall radiant error from such sources has been determined at around plus/minus 26 K in temperature. Wind speed and direction data, and how it affects the flame shape, is also included in the overall calculations to ensure altered distances and size do not reduce accuracy.

FIG. 1 illustrates an example oil and gas worksite 10 that may include a plurality of sensors 12 that may be used to monitor greenhouse gas emissions and/or gas emissions relating to flaring operations at the oil and gas worksite 10. For example, as illustrated in FIG. 1, in certain embodiments, the sensors 12 may include flare monitors 12A, tank sensors 12B, gas concentration monitors 12C, compressor health monitors 12D, structural monitors 12E, process monitors 12F, and/or wind sensors 12G. However, in other embodiments, the sensors 12 may include other types of sensors capable of providing data relating to greenhouse gas emissions and/or gas emissions relating to flaring operations. Furthermore, other types of data may be used to monitor greenhouse gas emissions and/or gas emissions relating to flaring operations at the oil and gas worksite 10 such as the time of day when the detection occurred and the sunrise/sunset time on that day, among other information.

In certain embodiments, as described in greater detail herein, one or more flare monitors 12A may be used to monitor flaring of one or more flares 14 at the oil and gas worksite 10 in order to prevent methane emissions by combusting methane into carbon dioxide. In certain embodiments, the one or more flare monitors 12A may be installed on, or in close proximity to (e.g., within a few feet of), the one or more flares 14. Substantial methane emissions may occur if flares 14 are unlit or burn inefficiently. The flares 14 may be monitored by many various types of flare monitors 12A. As described in greater detail herein, the one or more flare monitors 12A may be configured to detect radiant or thermal heat emitted by the one or more flares 14 for the purpose of determining the flaring efficiency of the one or more flares 14.

In certain embodiments, the flare monitors 12A may include one or more cameras, which may detect the absence of a flame from a particular flare 14, indicating that the particular flare 14 is unlit. In certain embodiments, the one or more cameras may detect the presence of black smoke emanating from a particular flare 14, indicating inefficient combustion via the particular flare 14. In addition, in certain embodiments, the flare monitors 12A may include one or more thermocouples or other temperature sensors, which may detect temperatures relating to a particular flare 14, indicating that the particular flare 14 is unlit or combusting inefficiently. In addition, in certain embodiments, the flare monitors 12A may include one or more light sensors configured to detect light proximate to a particular flare 14. In addition, in certain embodiments, the flare monitors 12A may include one or more carbon dioxide sensors to detect carbon dioxide concentrations in the vicinity around a particular flare 14. Low carbon dioxide concentrations in the vicinity of the particular flare 14 may indicate that the particular flare 14 is unlit or combusting inefficiently. In addition, in certain embodiments, the flare monitors 12A may include one or more flow sensors to detect a flow of gas into a particular flare 14. Low flow into the particular flare 14 may indicate that the particular flare 14 is not destroying as much methane as usual. Any of this non-limiting list of conditions relating to operation of flares 14 may be correlated with other data described herein to indicate that unintentional greenhouse gas emissions may be occurring relating to the flares 14.

In addition, in certain embodiments, one or more tank sensors 12B may be used to monitor operational statuses of one or more storage tanks 16 (e.g., oil or water storage tanks) at the oil and gas worksite 10. In addition, in certain embodiments, one or more gas concentration monitors 12C may be used to directly monitor gas concentrations at certain locations within the oil and gas worksite 10. In addition, in certain embodiments, one or more compressor health monitors 12D may be used to monitor certain operational statuses of one or more compressors 18 at the oil and gas worksite 10. In addition, in certain embodiments, one or more structural monitors 12E may be used to monitor one or more structures 20 at the oil and gas worksite 10, for example, as they evolve over time. In addition, in certain embodiments, one or more process monitors 12F may be used to monitor certain processes carried out by certain processing equipment 22 (e.g., valves, pipes, heat exchangers, manifolds, mixing chambers, and so forth) of the oil and gas worksite 10. In addition, in certain embodiments, one or more wind sensors 12G may be used to collect certain meteorological data relating to the oil and gas worksite 10.

Although described primarily herein as pertaining to oil and gas worksites 10, the term "oil and gas worksite" is intended to include any worksites 10 wherein gas is flared. Indeed, the embodiments described herein include systems and methods for identifying flaring efficiency from any types of worksites 10. In addition, the embodiments described herein may be applied to other types of gases or fluids flared from other types of worksites 10. In general, the embodiments described herein include monitoring the oil and gas worksite 10 with one or more sensors 12, as described in greater detail herein. Collectively, the sensors 12 described herein provide continuous measurement of fugitive and vented greenhouse gas emissions and/or gas emissions relating to flaring operations with respect to the oil and gas worksite 10.

In addition, as illustrated in FIG. 1, in certain embodiments, one or more of the sensors 12 (including flare monitors 12A) described herein may be mounted to mobile platforms 26, for example, a mobile robot (e.g., a Spot robot), an unmanned aerial vehicle (e.g., a drone), a satellite, an airplane, a helicopter, or any other relatively agile mobile platform configured to move around relative to an oil and gas worksite 10, carrying one or more sensors 12 (e.g., one or more flare monitors 12A) that can detect relevant data relating to greenhouse gas emissions and/or gas emissions relating to flaring operations that may be occurring at the oil and gas worksite 10, as described in greater detail herein.

Figure 2:
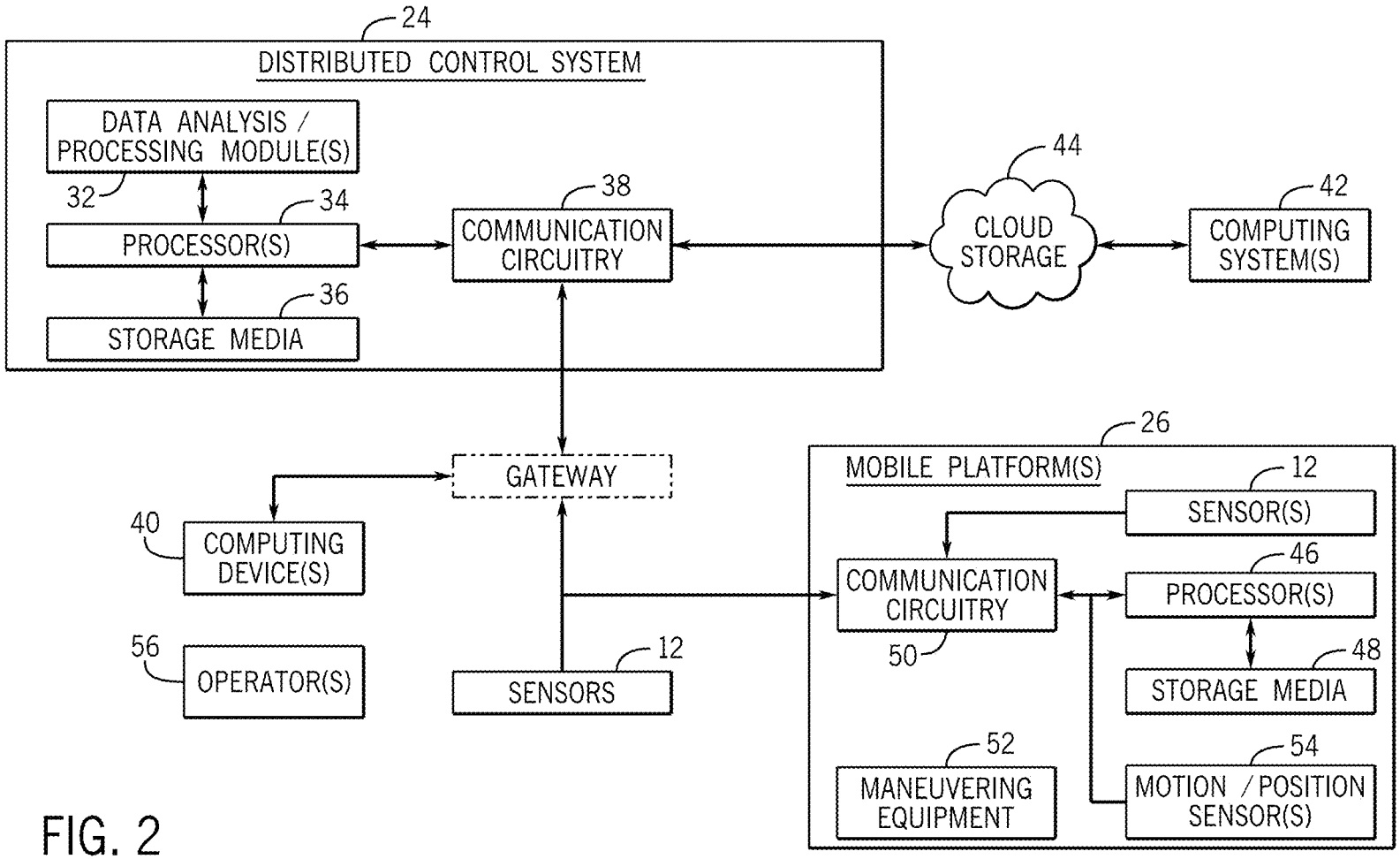
FIG. 2 illustrates a distributed control system (DCS) that includes one or more data analysis and processing modules configured to facilitate the determination of flaring efficiency, in accordance with embodiments of the present disclosure.

As illustrated in FIGS. 1 and 2, in certain embodiments, a distributed control system (DCS) 24 may include one or more data analysis and processing modules 32 (e.g., programs of computer-executable instructions and associated data) that may be configured to facilitate the flare efficiency monitoring functions of the embodiments described herein. In certain embodiments, to perform these various functions, a data analysis and processing module 32 executes on one or more processors 34 of the DCS 24, which may be connected to one or more storage media 36 of the DCS 24. Indeed, in certain embodiments, the one or more data analysis and processing modules 32 may be stored in the one or more storage media 36 of the DCS 24.

In certain embodiments, the one or more processors 34 of the DCS 24 may include a microprocessor, a microcontroller, a processor module or subsystem, a programmable integrated circuit, a programmable gate array, a digital signal processor (DSP), or another control or computing device. Alternatively or additionally, the one or more processors 34 of the DCS 24 may include discrete electronic components coupled to a printed circuit board, integrated circuitry (e.g., Application Specific Integrated Circuits (ASIC)), and/or programmable logic devices (e.g., a Field Programmable Gate Arrays (FPGA)).

In certain embodiments, the one or more data analysis and processing modules 32 may be implemented as computer program logic for use with the one or more processors 34 of the DCS 24. The computer program logic may be embodied in various forms, including a source code form or a computer executable form. Source code may include a series of computer program instructions in a variety of programming languages (e.g., an object code, an assembly language, or a high-level language such as C, C++, or JAVA). The computer instructions may be distributed in any form as a removable storage medium with accompanying printed or electronic documentation (e.g., shrink wrapped software), preloaded on the DCS 24 (e.g., on system ROM or fixed disk), or distributed from a server or electronic bulletin board over a communication system (e.g., the Internet or World Wide Web). In addition, in certain embodiments, the DCS 24 may be implemented as an edge device that is part of a cloud-based computing environment, and the computer program logic may be executed by the edge device in the cloud-based computing environment.

In certain embodiments, the one or more storage media 36 of the DCS 24 may be implemented as one or more non-transitory computer-readable or machine-readable storage media. In certain embodiments, the one or more storage media 36 of the DCS 24 may include one or more different forms of memory including semiconductor memory devices such as dynamic or static random access memories (DRAMs or SRAMs), programmable read-only memories (PROMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); PC cards (e.g., PCMCIA cards), or other types of storage devices.

As described above, in certain embodiments, the computer-executable instructions and associated data of the data analysis and processing module(s) 32 may be provided on one computer-readable or machine-readable storage medium of the storage media 36 of the DCS 24, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 36 of the DCS 24 may be located either in the machine running the machine-readable instructions, or may be located at a remote site from which machine-readable instructions may be downloaded over a network for execution. Indeed, in certain embodiments, the DCS 24 may be implemented as an edge device that is part of a cloud-based computing environment, and the machine-readable instructions may be executed by the edge device in the cloud-based computing environment.

In certain embodiments, the processor(s) 34 of the DCS 24 may be connected to communication circuitry 38 of the DCS 24 to allow the DCS 24 to communicate with the various sensors 12, the mobile platforms 26, equipment located at the oil and gas worksite 10, one or more computing devices 40 (e.g., smart phones, tablets, laptop computers, desktop computers, and other types of computing devices), and/or one or more external computing systems 42 for the purpose of automatically determining flaring efficiency of the oil and gas worksite 10 over time, and facilitating the reduction of the greenhouse gas emissions and/or gas emissions relating to flaring operations at the oil and gas worksite 10, as described in greater detail herein. In certain embodiments, the communication circuitry 38 of the DCS 24 may also facilitate the DCS 24 communicating data to cloud storage 44 (or other wired and/or wireless communication network) to, for example, archive the data or to enable external computing systems 42 to access the data and/or to remotely interact with the DCS 24.

Regardless of the destination for the communication, in certain embodiments, the processor(s) 34 and/or the communication circuitry 38 may be configured to automatically convert the data that is communicated into a data format suitable for transmission to and use by the particular destination to which the data is transmitted. For example, in certain embodiments, certain types of sensors 12, mobile platforms 26, and/or equipment located at one or more oil and gas worksites 10 may only be capable of receiving and acting upon data in particular data formats. As such, in such scenarios, the processor(s) 34 and/or the communication circuitry 38 may automatically convert data to be transmitted to such sensors 12, mobile platforms 26, and/or equipment into the particular data formats before transmitting the data to the sensors 12, mobile platforms 26, and/or equipment. In addition, in certain embodiments, the processor(s) 34 may be configured to automatically transmit command signals to the computing devices 40 to, for example, launch an application running on the computing devices 40 to notify an operator of certain updates relating to flaring efficiency at one or more oil and gas worksites 10 as they occur in substantially real time. Such automated data conversion and transmission enables the DCS 24 to more effectively communicate data to operators. In addition, in certain embodiments, the processor(s) 34 may be configured to automatically adjust parameters of the flare 14 based at least in part on the flaring efficiency that is determined by the processor (s) 34.

In certain embodiments, the communication circuitry 38 of the DCS 24 may be, include, or be implemented by various types of standard interfaces, such as an Ethernet interface, a universal serial bus (USB), a third generation input/output (3GIO) interface, a wireless interface, a cellular interface, and/or a satellite interface, among others. In certain embodiments, the communication circuitry 38 of the DCS 24 may also include a communication device, such as a modem or network interface card to facilitate exchange of data with external computing devices via a network (e.g., Ethernet connection, digital subscriber line (DSL), telephone line, coaxial cable, cellular telephone system, satellite, etc.).

In addition, as also illustrated in FIG. 2, in certain embodiments, the one or more mobile platforms 26, which each may have one or more sensors 12 (e.g., one or more flare monitors 12A) attached to it, may also include one or more processors 46 (e.g., similar to the processors 34 of the DCS 24) configured to run computer program logic, which may be embodied in various forms (e.g., similar to the data analysis and processing modules 32 of the DCS 24) and may be stored in storage media 48 of the respective mobile platform 26 (e.g., which may be similar to the storage media 36 of the DCS 24) to automatically (e.g., autonomously) control maneuvering of the respective mobile platform 26 around the oil and gas worksite 10 for the purpose of repositioning its respective sensors 12 such that the sensors 12 can, for example, detect data relating to flaring occurring at the oil and gas worksite 10, as described in greater detail herein.

In certain embodiments, the processor(s) 46 of the mobile platform(s) 26 may be connected to communication circuitry 50 of the respective mobile platform 26 (e.g., which may be similar to the communication circuitry 38 of the DCS 24) to allow the respective mobile platform 26 to communicate with the DCS 24, the various sensors 12, other mobile platforms 26, equipment located at the oil and gas worksite 10, the computing devices 40, and/or external computing systems 42 for the purpose of determining how to automatically (e.g., autonomously) maneuver itself around the oil and gas worksite 10 to enable its respective sensors 12 to, for example, detect data relating to flaring occurring at the oil and gas worksite 10, as described in greater detail herein. In certain embodiments, the communication circuitry 50 of the mobile platform(s) 26 may also facilitate the respective mobile platform 26 to communicate data to the cloud storage 44 (or other wired and/or wireless communication network) to, for example, archive the data or to enable external computing systems 42 to access the data and/or to remotely interact with the respective mobile platform 26.

In certain embodiments, the processor(s) 46 of the mobile platform(s) 26 may execute computer program logic to determine how to automatically (e.g., autonomously) control maneuvering equipment 52 of the respective mobile platform 26 to enable the maneuvering equipment 52 to maneuver the respective mobile platform 26 around the oil and gas worksite 10 for the purpose of repositioning its respective sensors 12 such that the sensors 12 can, for example, detect data relating to flaring occurring at the oil and gas worksite 10, as described in greater detail herein. For example, in certain embodiments, a mobile platform 26 may be an unmanned aerial vehicle (e.g., a drone) and the maneuvering equipment 52 may include propellers, motors configured to rotate the propellers at specific speeds, and so forth, configured to enable the unmanned aerial vehicle to maneuver the mobile platform 26 aerially about the oil and gas worksite 10. However, in other embodiments, a mobile platform 26 may be a mobile robot and the maneuvering equipment 52 may include robotic legs, wheels, and so forth, configured to maneuver the mobile platform 26 over the ground and certain structures 20 and/or equipment of the oil and gas worksite 10. In addition, in other embodiments, a mobile platform 26 may be an airplane, helicopter, or satellite and the maneuvering equipment 52 may include suitable equipment capable of maneuvering the mobile platform 26 relative to the oil and gas worksite 10.

In certain embodiments, the processor(s) 46 of the mobile platform(s) 26 may execute computer program logic to determine how to automatically (e.g., autonomously) control maneuvering equipment 52 of the respective mobile platform 26 based at least in part on one or more motion/position sensors 54 of the respective mobile platform 26. As used herein, the term "motion/position sensor" may refer not only to a sensor configured to detect motion and/or a position, such as accelerometers, gyroscopes, and so forth, but also any and all other types of sensors, such as LIDAR devices and/or cameras, global positioning systems (GPS), and so forth, which may provide feedback data that may be used to determine motion and/or position of a respective mobile platform 26 relative to the oil and gas worksite 10. In certain embodiments, the DCS 24 may be configured to automatically send control signals to the mobile platform(s) 26 to at least partially control the maneuvering of a particular mobile platform 26 when, for example, the DCS 24 determines that certain data relating to particular flaring may be useful, and that a particular sensor 12 (e.g., a particular flare monitor 12A) attached to the particular mobile platform 26 may be capable of collecting such data of interest.

Figure 3:
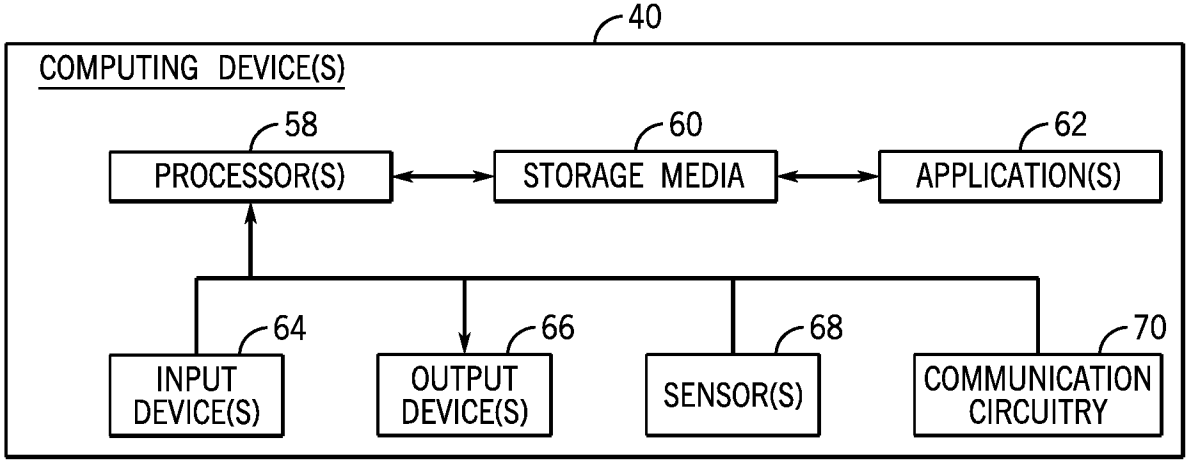
FIG. 3 illustrates various components of computing devices, which facilitate operators interacting with the DCS of FIG. 2, in accordance with embodiments of the present disclosure.

In general, the DCS 24 enables one or more operators 56 to interact with one or more computing devices 40 (and/or one or more external computing systems 42) to use the flaring-related data that is collected, analyzed, and interpreted by the DCS 24, as described in greater detail herein. FIG. 3 illustrates various components of the computing devices 40 described herein, which facilitate the operators 56 interacting with the DCS 24 of FIG. 2, as described in greater detail herein. It will be appreciated that the external computing systems 42 described herein may include similar components to also facilitate operators 56 interacting with the DCS 24, as described in greater detail herein.

In certain embodiments, the computing device(s) 40 may include one or more processor(s) 58. In certain embodiments, the processor(s) 58 may be operatively connected to one or more storage media 60, and may execute coded instructions, such as applications 62, present in the storage media 60. In certain embodiments, the processor(s) 58 may execute, among other things, the machine-readable coded instructions to implement the techniques described herein. In certain embodiments, the applications 62 stored in the storage media 60 may include program instructions or computer program code that, when executed by the processor(s) 58 of the computing device(s) 40, may facilitate the DCS 24 performing the techniques described herein. In certain embodiments, the processor(s) 58 may include one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

In certain embodiments, the storage media 60 may include random access memory (RAM), static random access memory (SRAM), synchronous dynamic random access memory (SDRAM), dynamic random access memory (DRAM), RAMBUS dynamic random access memory (RDRAM), and/or other types of random access memory devices. In addition, in certain embodiments, the storage media 60 may include read-only memory, flash memory, and/or other types of memory devices.

In certain embodiments, the computing device(s) 40 may include one or more input device(s) 64, which may permit operators 56 to make certain inputs to the DCS 24. In certain embodiments, the input device(s) 64 may include a keyboard, a mouse, a joystick, a touchscreen, a trackpad, and/or a trackball. In addition, in certain embodiments, the input device(s) 64 may include a facial recognition device, voice recognition device, and/or biometric data entry device, among other examples, which may be used to authenticate an operator 56 associated with the respective computing device 40 for the purpose of authorizing entry and/or access to various information associated with the particular operator 56 that is managed by the DCS 24. For example, in certain embodiments, an operator 56 may be identified by the input device(s) 64, and information managed by the DCS 24 may be accessed to ensure that the operator 56 should be allowed access to certain data, functions, and so forth. In certain embodiments, the computing device(s) 40 may include one or more audiovisual output device(s) 66, which may permit operators 56 to view, hear, feel, and so forth, certain outputs (e.g., alarms, warnings, instructions, and so forth) relating to information managed by the DCS 24. In certain embodiments, the audiovisual output device(s) 66 may include video output devices (e.g., an LCD, an LED display, a CRT display, a touchscreen, etc.), speakers, and haptic feedback devices, among other examples.

In certain embodiments, the computing device(s) 40 may also include one or more sensor(s) 68 that facilitate collection of certain data. For example, in certain embodiments, the one or more sensor(s) 68 may include global positioning systems and/or facial recognitions systems, for example, configured to provide information relating to a location of the respective computing device 40 and, by extension, of an operator 56 associated with the respective computing device 40, wherein the location information may be used by the DCS 24 to approximate a location of the operator 56, for example, with respect to the oil and gas worksite 10 and/or particular equipment of the oil and gas worksite 10.

In certain embodiments, the computing device(s) 40 may also include communication circuitry 70, which may include various types of standard interfaces, such as an Ethernet interface, a universal serial bus (USB), a third generation input/output (3GIO) interface, a wireless interface, a cellular interface, and/or a satellite interface, among others. In certain embodiments, the communication circuitry 70 may also include a communication device, such as a modem or network interface card to facilitate exchange of data with the DCS 24, the various sensors 12, the mobile platforms 26, equipment located at the oil and gas worksite 10, and/or external computing systems 42 to facilitate the functionality of the DCS 24, as described in greater detail herein.

Figure 4:
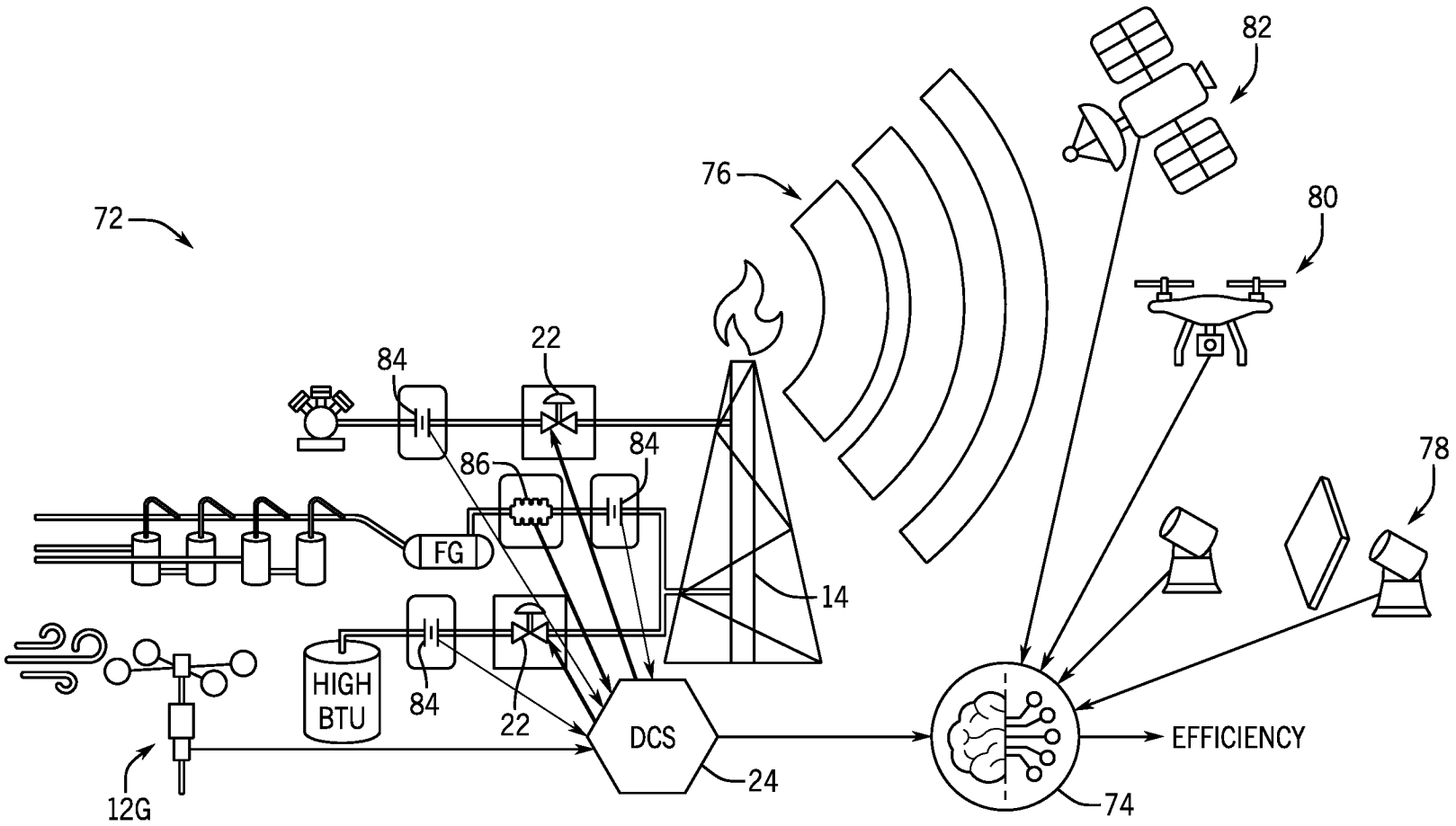
FIG. 4 illustrates a configuration of an overall radiant or thermal flare efficiency monitoring solution, in accordance with embodiments of the present disclosure.

FIG. 4 illustrates a configuration of the overall radiant or thermal flare efficiency monitoring solution 72 presented herein. As described in greater detail herein, the flaring efficiency 74 of one or more flares 14 may be determined by the DCS 24 based data relating to radiant or thermal heat 76 taken from ground sources 78 (i.e., flare monitors 12A located at or near a surface of an oil and gas worksite 10), air sources 80 (drones, airplanes, helicopters, and so forth, flying above and in relative proximity to an oil and gas worksite 10), or satellite sources 82 (satellites positioned above an oil and gas worksite 10). In certain embodiments, ground opportunities having a redundant shielded measurement option for improved accuracy due to ambient conditions.

As illustrated in FIG. 4 and described above with respect to FIG. 1, in certain embodiments, other data captured by other sensors 12 disposed about an oil and gas worksite 10 may also be used by the DCS 24 to determine the flaring efficiency 74 of one or more flares 14 at the oil and gas worksite 10. For example, in certain embodiments, wind speed and direction data may be captured by one or more wind sensors 12G and the DCS 24 may use this wind speed and direction data to analyze how the wind speed and direction affect the shape of the flame of the one or more flares 14 to ensure altered distances and size do not reduce accuracy. However, data from any and all of the other sensors 12 illustrated in FIG. 1 may also be used by the DCS 24 to determine the flaring efficiency 74 of the one or more flares 14.

For example, as illustrated in FIG. 4, in certain embodiments, one or more flow meters 84 may capture oil and gas flow rates of oil and gas being processed at the oil and gas worksite 10, and the DCS 24 may determine the flaring efficiency 74 of the one or more flares 14 based at least in part on the oil and gas flow rates. In addition, in certain embodiments, one or more inline compositional analyzers 86 may continuously monitor compositions (e.g., percentages of mass, percentages of volume, and so forth) of individual components of oil and gas being processed at the oil and gas worksite 10, and the DCS 24 may determine the flaring efficiency 74 of the one or more flares 14 based at least in part on the compositional data. In addition, in certain embodiments, the DCS 24 may automatically control equipment 22 (e.g., valves, pipes, heat exchangers, manifolds, mixing chambers, and so forth) of the oil and gas worksite 10 based on the flaring efficiency of the one or more flares 14 that is determined by the DCS 24, as described in greater detail herein.

Figure 5:
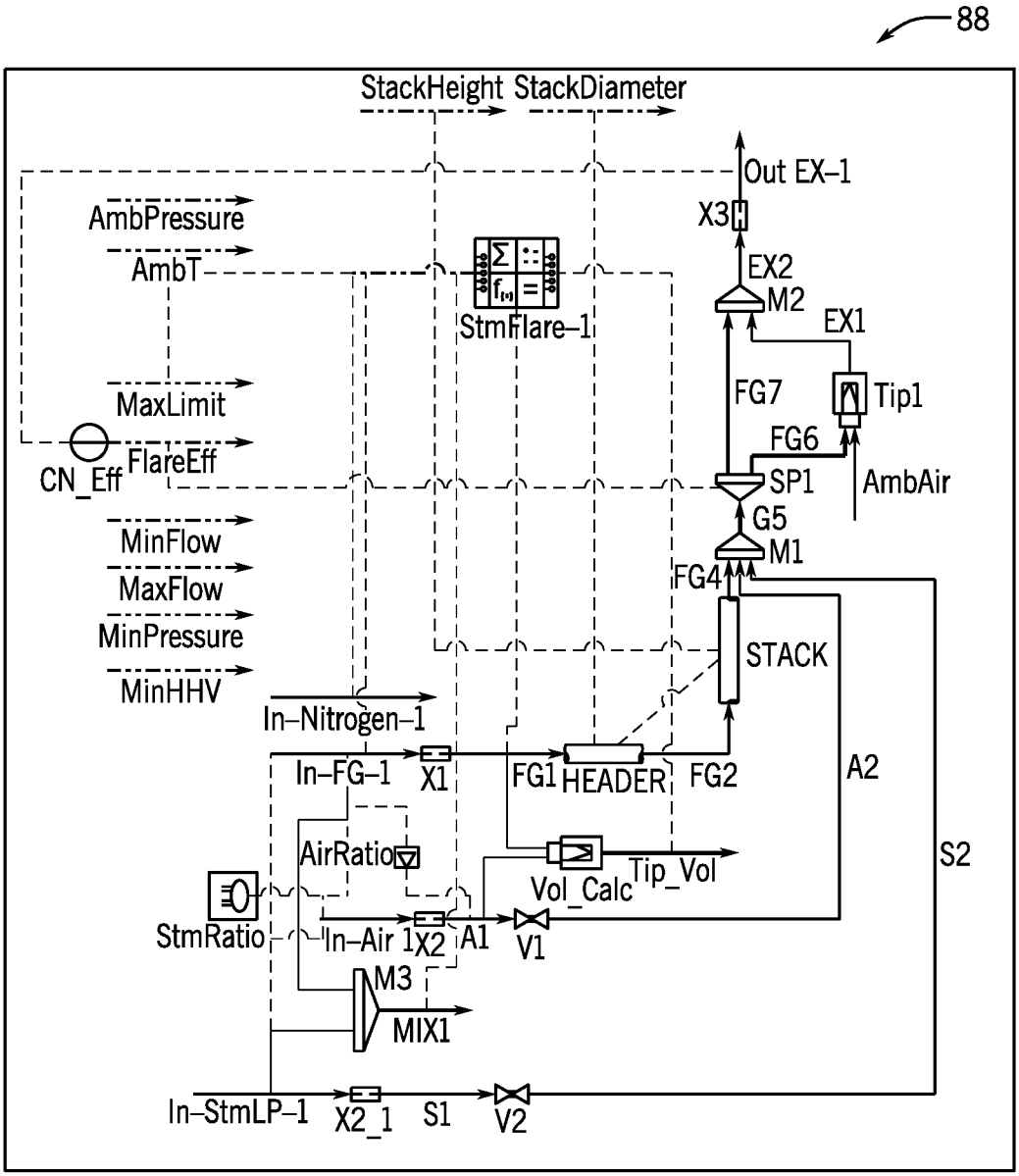
FIG. 5 is a visual representation of an example simulation model that may be used by the DCS to determine the flaring efficiency of a flare, in accordance with embodiments of the present disclosure.

FIG. 5 is a visual representation of an example simulation model 88 that may be used by the DCS 24 to determine the flaring efficiency of a flare 14. As illustrated, in certain embodiments, the simulation model 88 may convert the final average temperature estimation of the flame of the flare 14 to combustion efficiency 74 of the flare 14. As also illustrated, in certain embodiments, inputs into the simulation model 88 may include the flare stack height and tip diameter, flare gas compositions and flow, steam or air assist flow and conditions, and any supplementary high calorific gas. In certain embodiments, efficiency percentage may be determined by the DCS 24 as the fraction of fluids going into the burner unit operation ("Tip1") instead of into the bypass stream.

In particular, as illustrated in FIG. 5, inputs into the simulation model 88 may include flow rates and other properties of nitrogen ("In-Nitrogen-1"), flare gas ("In-FG-1"), air ("In-AIR-1"), and low-pressure steam ("In-SteamLP-1") that are input into the flare 14. As illustrated, in certain embodiments, the flare gas ("In-FG-1") may be modeled as flowing through flow line FG1 into a Header of the flare 14 and then through flow line FG2 into a Stack of the flare 14. In addition, in certain embodiments, the air ("In-AIR-1") may be modeled as being controlled by a valve V1 (e.g., based at least in part on a ratio of the air ("In-AIR-1") to the flare gas ("In-FG-1") as determined by an AirRatio), flowing through flow lines A1 and A2, and being mixed with the flare gas ("In-FG-1") and the low-pressure steam ("In-SteamLP-1"), which is modeled as being controlled by another valve V2 and flowing through flow lines S1 and S2, in a mixing chamber M1 of the flare 14 to create a mixed gas in flow line G5. As illustrated, in certain embodiments, a volume calculation module ("Vol_Calc") may be used to determine a volume ("Tip_Vol") at the tip ("Tip1") of the flare 14 based on the properties of the flare gas ("In-FG-1") and the air ("In-AIR-1"). In addition, in certain embodiments, a mixture ("Mix1") of the flare gas ("In-FG-1") and the low-pressure steam ("In-SteamLP-1") may be modeled via another mixing chamber M3.

In addition, in certain embodiments, the mixed gas flowing through the flow line G5 may be modeled as being separated into a first portion that is flared (e.g., via flow line FG6) at the tip ("Tip1") of the flare 14 and a second portion that bypasses the tip ("Tip1") of the flare 14 (e.g., via flow line FG7) using a separator SP1. As will be appreciated, the first portion of the gas in the flow line FG6 that is flared is modeled as combusting with ambient air ("AmbAir") at the tip ("Tip1") of the flare 14, and the remaining exhaust gas may flow through exhaust flow line EX1 and be modeled as being mixed with the second portion of the gas in the flow line FG7 in a mixer M2 to create the output gas ("Out-Ex-1") flowing through flow line EX2.

As described in greater detail herein, in certain embodiments, the flaring efficiency ("FlareEff") may be determined by comparing (e.g., using a comparator CN_eff) determined flaring temperature (e.g., as determined based on the radiant or thermal heat 76 detected by one or more sensors 12 described herein) to a theoretical flaring temperature determined using a simulation model (e.g., such as the simulation model 88 illustrated in FIG. 5). For example, in certain embodiments, an average flare flame temperature may first be determined, and a fluid mixture ("Mix1") and total flow rate ("Tip_Vol") at the tip ("Tip1") of the flare 14 may be calculated. Then, a fraction of fluid combusted at the tip ("Tip1") of the flare 14 (e.g., to flow through the flow line FG6) may be estimated, and a Gibbs energy minimization to predict combusted product composition may be performed on the fluid combusted at the tip ("Tip1") of the flare 14. Then, the combusted fluids (e.g., flowing through flow line EX1) may be modeled as being mixed with the bypass fluids (e.g., flowing through flow line G7) in the mixer M2, and an energy balanced temperature of the mixture (e.g., flowing through flow line EX2) to determine a theoretical flaring temperature ("Out-Ex-1"), which may be compared to the measured temperature (e.g., determined flaring temperature, as determined based on the radiant or thermal heat 76 detected by one or more sensors 12 described herein). If the theoretical flaring temperature ("Out-Ex-1") matches the determined flaring temperature (e.g., within a predetermined threshold percentage), then the final bypass fraction (e.g., flowing through flow line G7) may be determined to be the flaring efficiency ("FlareEff"). Conversely, if the theoretical flaring temperature ("Out-Ex-1") does not match the determined flaring temperature (e.g., within the predetermined threshold percentage), then a new fraction of fluid combusted at the tip ("Tip1") of the flare 14 (e.g., to flow through the flow line FG6) may be estimated, and a next iteration of the calculations may be performed. It will be appreciated that this iterative process may be repeated until the theoretical flaring temperature ("Out-Ex-1") matches the determined flaring temperature (e.g., within the predetermined threshold percentage).

In other embodiments, as opposed to comparing a determined flaring temperature to a theoretical flaring temperature ("Out-Ex-1") to determine the flaring efficiency ("FlareEff"), the radiant or thermal heat 76 detected by one or more sensors 12 may instead be directly compared to a theoretical radiant or thermal heat that is determined by the simulation model 88. In other words, the additional step of determining the flaring temperature based on the radiant or thermal heat 76 detected by one or more sensors 12 may not be performed by the simulation model 88. Instead, the simulation model 88 may directly compare the radiant or thermal heat 76 detected by one or more sensors 12 to a theoretical radiant or thermal heat that is determined by the simulation model 88.

As illustrated in FIG. 5, in certain embodiments, a calculation engine ("StmFlare-1") may be used to determine the many parameters used by the simulation model 88 including, but not limited to height (e.g., StackHeight) of the Stack of the flare 14, diameter (e.g., StackDiameter) of the Stack of the flare 14, pressure ("AmbPressure") and temperature ("AmbT") of the ambient air proximate the tip ("Tip1") of the flare 14, minimum flow rate ("MinFlow") of the flare gas, maximum flow rate ("MaxFlow") of the flare gas, minimum pressure ("MinPressure") of the flare gas, minimum higher heating value ("MinHHV") of the flare gas, and so forth.

Figure 6:
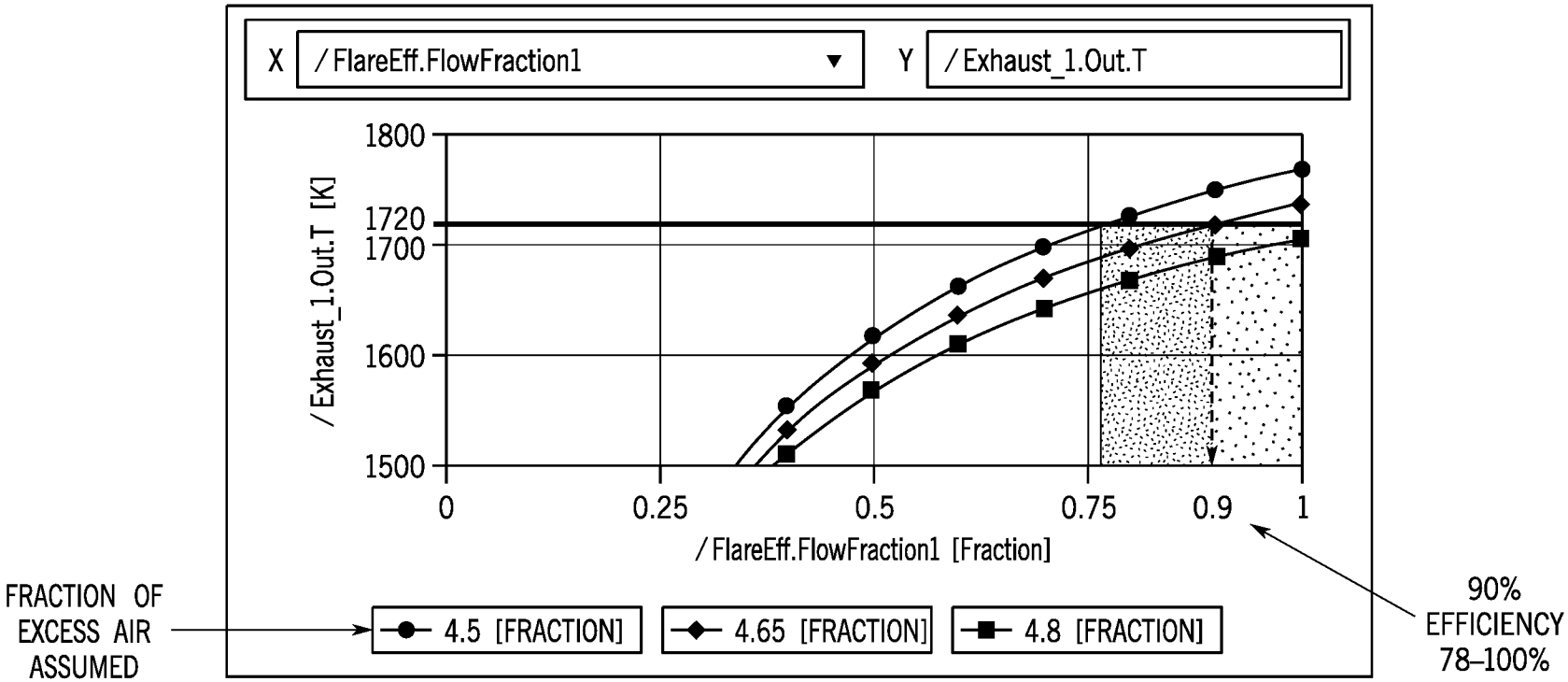
FIG. 6 illustrates predicted flare efficiency of a flare versus exhaust temperature of the flare for three different fractions of assumed excess assist air when the excess assist air is unknown, in accordance with embodiments of the present disclosure.
Figure 7:
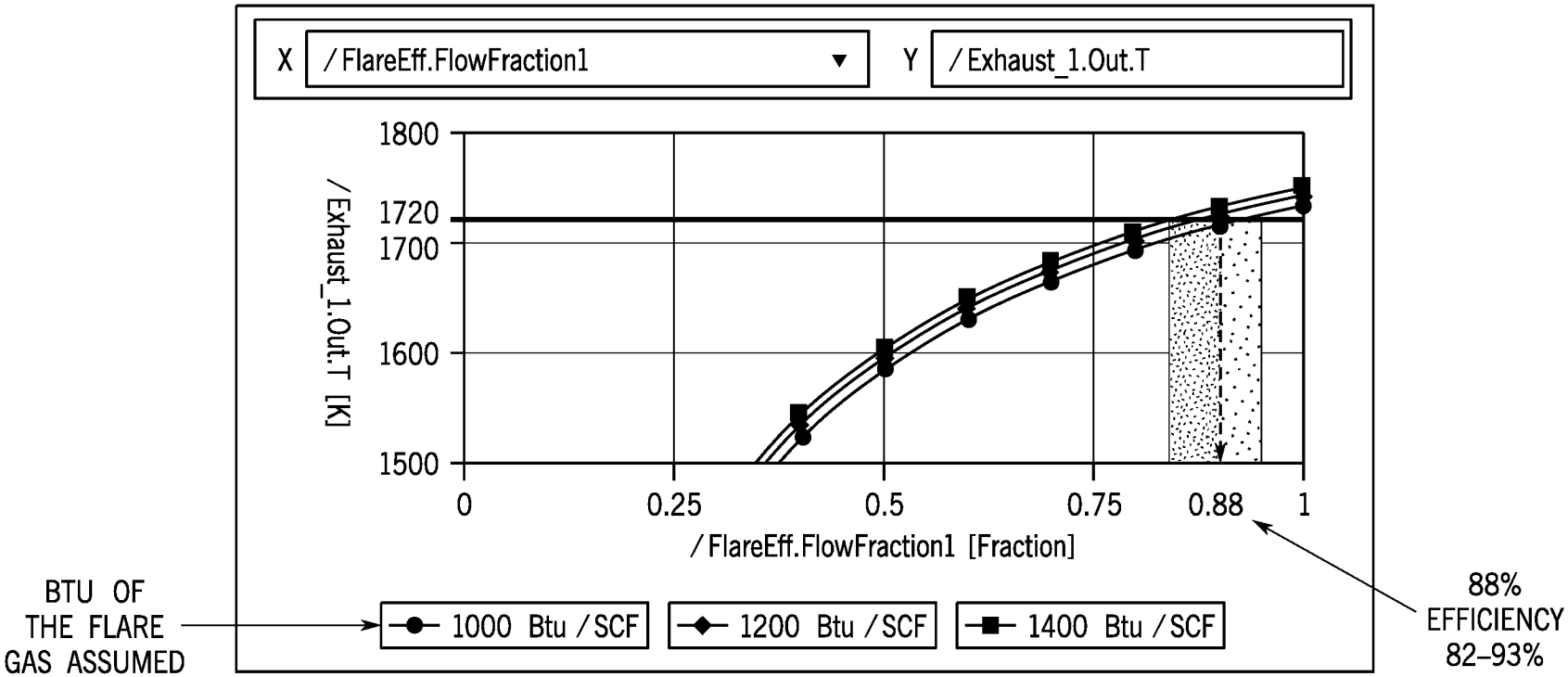
FIG. 7 illustrates predicted flare efficiency of a flare versus exhaust temperature of the flare for three different assumed calorific value of the flare gas when the calorific value of the flare gas is unknown, in accordance with embodiments of the present disclosure.

FIGS. 6 and 7 illustrate the uncertainty of predicted flare efficiency with different levels of unknown measurements of a flare process. In particular, FIG. 6 illustrates predicted flare efficiency of a flare 14 ("FlareEff.FlowReaction1", as fraction of flare gas) versus exhaust temperature of the flare 14 ("Exhaust_1.Out.T", as degrees K) for three different fractions of assumed excess assist air (4.5%, 4.65%, and 4.8%) when the excess assist air is unknown. At 1720 K, the flare efficiency of the flare 14 may be in a range of 78-100% (e.g., 90%). In addition, FIG. 7 illustrates predicted flare efficiency of a flare 14 ("FlareEff.FlowReaction1", as fraction of flare gas) versus exhaust temperature of the flare 14 ("Exhaust_1.Out.T", as degrees K) for three different assumed calorific value of the flare gas (1000 Btu/SCF, 1200 Btu/SCF, and 1400 Btu/SCF) when the calorific value of the flare gas is unknown. At 1720 K, the flare efficiency of the flare 14 may be in a range of 82-93% (e.g., 88%). It will be appreciated that the back calculation of radiant heat to efficiency requires relatively complete information of the flare process to be of relatively high-level accuracy.

Figure 8:
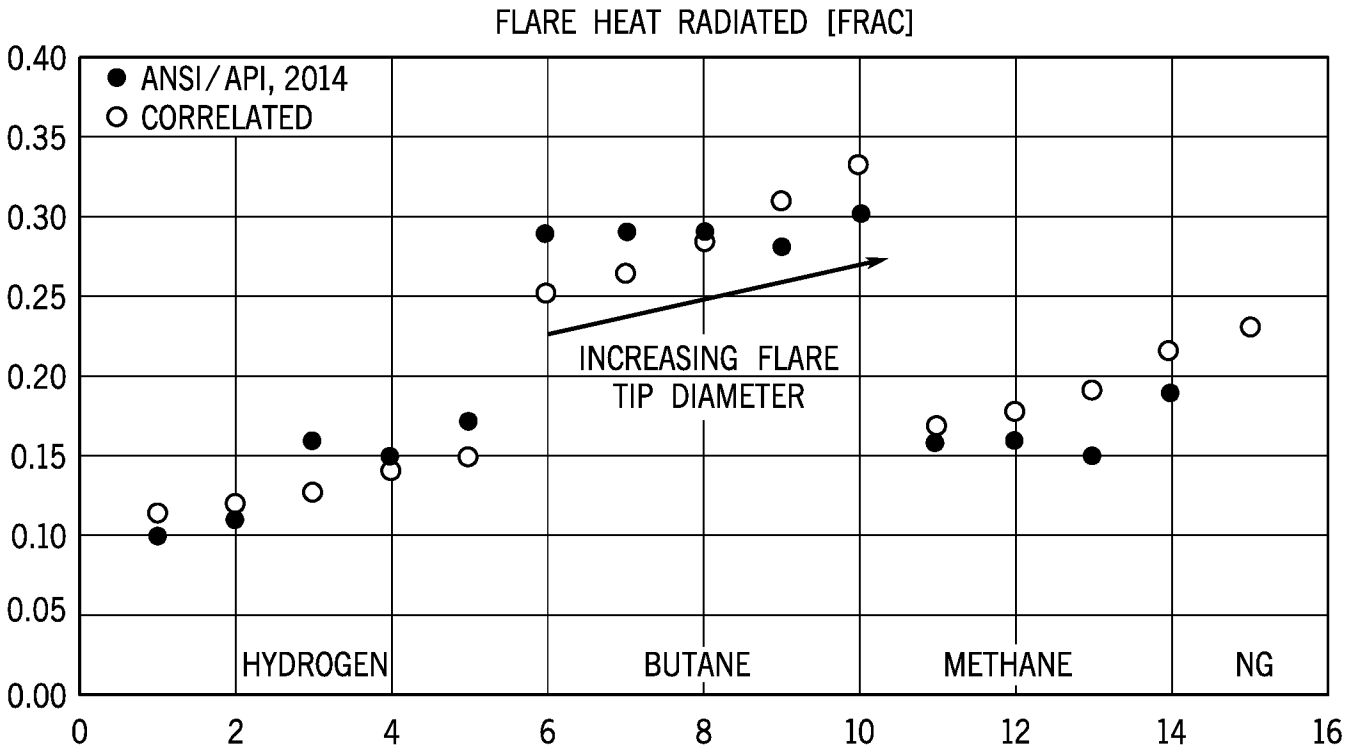
FIG. 8 illustrates predicted flare heat radiated fraction used in the overall calculation for flare efficiency of a flare for various different components of the flare gas at various different flare tip diameters, in accordance with embodiments of the present disclosure.

When looking at calculating the temperature of a flame of a flare 14, Equation 3 includes a general formula that can be used in situations of correlating radiant heat versus temperature of the flame of the flare 14. There are considerations in the radiant heat emission term from the flame of the flare 14, which are dependent on the calorific value of the combusted gas and flare tip diameter. These terms may increase in accuracy away from constant values with regressed data. FIG. 8 illustrates predicted flare heat radiated fraction used in the overall calculation for flare efficiency of a flare 14 for various different components of the flare gas (e.g., hydrogen, butane, and methane) at various different flare tip diameters.

$$Q_{rad} = \frac{\sigma \cdot F \cdot \left(T_{Flame}^4 - T_{Analyzer}^4\right)}{\frac{1}{\varepsilon_1} + \frac{1}{\varepsilon_2} - 1} \quad \text{(Eq. 3)}$$

where $Q_{rad}$=radiant heat measured, D=distance from the measured heat source, σ=Stefan-Boltzmann constant, T=temperature of the flare 14 or analyzer, $\varepsilon_1$=emissivity of the source (e.g., possible estimate based on atomic gas makeup), $\varepsilon_2$=emissivity of the measurement surface, F=view factor of the flame to the measurement, $$\left(\sim \frac{SA}{4\pi D^2}\right)$$

for on-site devices where the distance is relatively large compared to the size of the flare 14 and SA indicates the surface area of the detecting device.

For wind considerations, the main term that needs to be adjusted is the "view factor", or "F", in Equation 3. In the situation of most applications, there would be a benefit to calibrating the radiant heat to flare flame temperature with a visual measurement of relatively high accuracy. An example of a high accuracy reference would be from the LiDAR solution. With this accurate reference point, any discrepancy in flare efficiency to flame temperature may be eliminated with a constant multiplier (similar to the "view factor", or "F", in Equation 3). Such equation, solving for the flare average flame temperature, is illustrated in Equation 4.

$$T_{Flame} = \sqrt[4]{\left[\frac{Q_{rad} \cdot \left(\frac{1}{\varepsilon_1} + \frac{1}{\varepsilon_2} - 1\right)}{\sigma \cdot F \cdot M}\right] + T_{Analyzer}^4} \quad \text{(Eq. 4)}$$

where M=multiplier for calibration to high accuracy visual measurement data.

Figure 9:
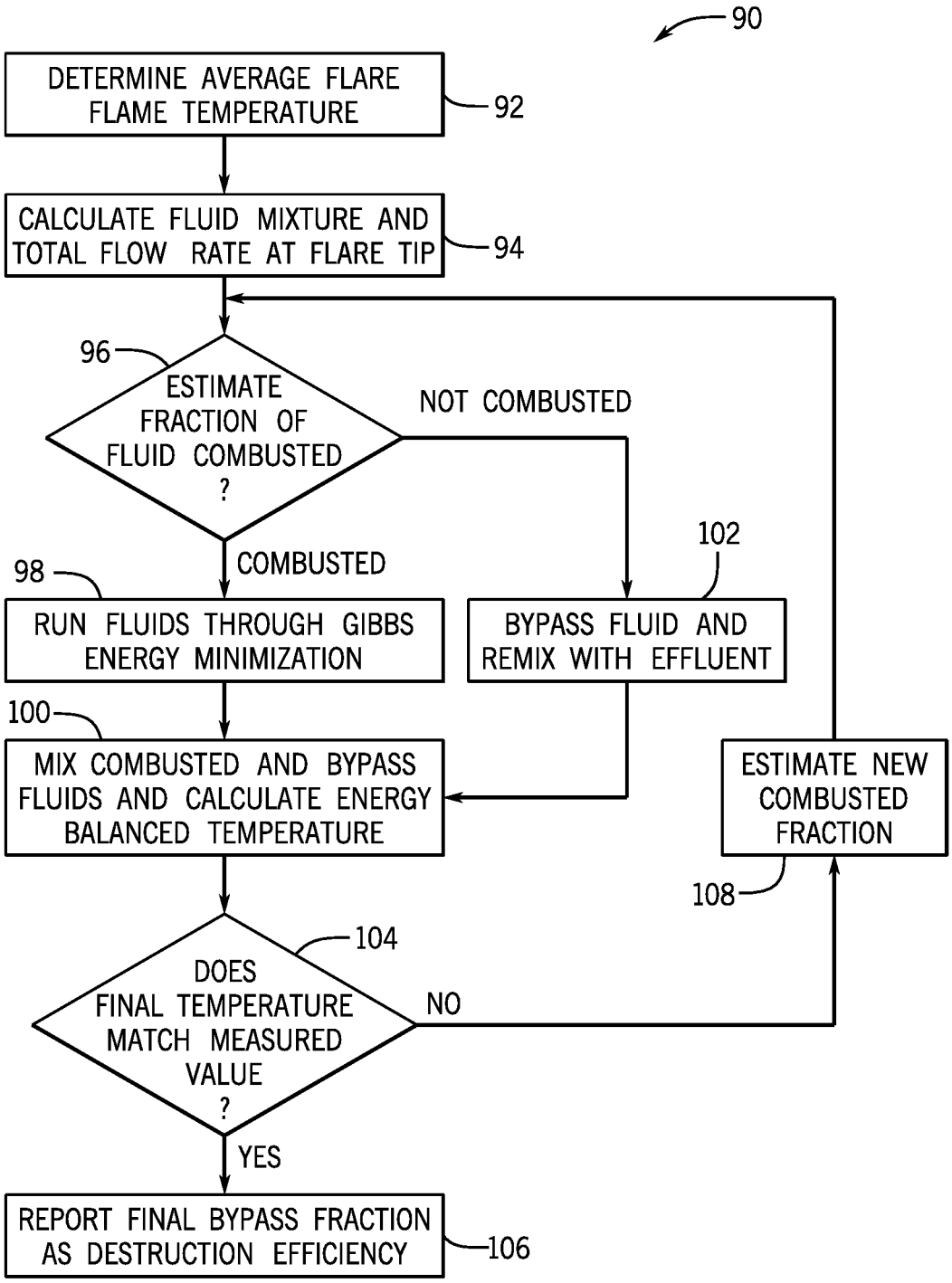
FIG. 9 illustrates a logic flow diagram for the estimation of flare efficiency from an average temperature determined from calibrated measurements, in accordance with embodiments of the present disclosure.

FIG. 9 illustrates a logic flow diagram 90 for the estimation of flare efficiency from an average temperature determined from calibrated measurements by the DCS 24 (e.g., using the simulation model 88 illustrated in FIG. 5). As illustrated, in certain embodiments, average flare flame temperature may be determined by the DCS 24 (block 92) and fluid mixture and total flow rate at the flare tip may be calculated by the DCS 24 (block 94). Based on this information, an estimation of a fraction of fluid combusted at the flare 14 is performed by the DCS 24 (decision 96). If it is determined at decision 96 that a first fraction of fluid is combusted, a Gibbs energy minimization may be determined for these combusted fluids by the DCS 24 (block 98), the combusted and bypass fluids may be modeled as mixed by the DCS 24, and the energy balanced temperature of the mixture may be calculated by the DCS 24 (block 100). Conversely, for a second fraction of fluid that is not combusted, the Gibbs energy minimization of block 98 may be bypassed, these bypass fluids may be modeled as bypassing the combustion by the DCS 24 (block 102), the combusted and bypass fluids may be modeled as mixed by the DCS 24, and the energy balanced temperature may be calculated by the DCS 24 (block 100). Regardless, a determination may be made by the DCS 24 of whether the final flaring temperature determined by the DCS 24 matches the measured flaring temperature (e.g., within a predetermined threshold) that is detected by the sensors 12 (e.g., flare monitor 12A) as described in greater detail herein (decision 104). If it is determined by the DCS 24 at decision 104 that the final flaring temperature matches the measured flaring temperature, then the final bypass fraction may be reported as destruction efficiency (flaring efficiency) (block 106). Conversely, if it is determined by the DCS 24 at decision 104 that the final flaring temperature does not match the measured flaring temperature, then a new combusted fraction may be estimated (block 108) and the logic flow diagram 90 returns to decision 96. In certain embodiments, the DCS 24 may also automatically adjust parameters of the flare 14 based at least in part on the flaring efficiency that is determined by the DCS 24.

Again, as described above, in other embodiments, as opposed to comparing the measured flaring temperature to the flaring temperature determined by the DCS 24 to determine the destruction efficiency (flaring efficiency), the radiant or thermal heat 76 detected by one or more sensors 12 may instead be directly compared to a theoretical radiant or thermal heat that is determined by the DCS 24. In other words, the additional step of determining the flaring temperature based on the radiant or thermal heat 76 detected by one or more sensors 12 may not be performed by the DCS 24. Instead, the DCS 24 may directly compare the radiant or thermal heat 76 detected by one or more sensors 12 to a theoretical radiant or thermal heat that is determined by the DCS 24.

As described in greater detail herein, the calculations mentioned on Gibbs energy minimization (for the combustion reactions) and energy balance (to calculate the final flame temperature) may be completed by the DCS 24 in a simulation engine such as the simulation model 88 illustrated in FIG. 5. This calculation provides the destruction efficiency (flaring efficiency) of the flare 14, although through the simulation engine, the combustion efficiency (flaring efficiency) may instead also be possible with combustion kinetics being applied. In this later situation, the overall kinetic rates of all reaction pathways would be the adjustable variable that replaces the bypass fraction in the former described solution.

As described in greater detail herein, multiple different measurement techniques using various different sensors 12 (e.g., flare monitors 12A) may be used by the DCS 24 to determine the average flare flame temperature or its radiant heat output, which may be back computed to flare temperature. For example, the simplest solution is to insert one or more temperature probes (such as a high temperature thermocouples) directly into the flare 14 in certain embodiments. Alternatively, in certain embodiments, the radiant heat flux may be measured using a blackened absorber located a fixed distance from the flare 14. In this measurement, the temperature of the absorber is proportional to the radiant heat emitted from the flare 14 with a correction applied for losses due to radiative cooling from the ambient environment. In addition, in certain embodiments, a third method may be to use a technique similar to that for thermal cameras. In such embodiments, due to the relatively high temperature of the flare 14, shorter wavelengths need to be observed to calculate the distribution of temperature across the flare 14, and with careful choice of that wavelength, confounding effects from atmospheric absorption may be reduced (e.g., from carbon dioxide, hydrocarbons, water, and so forth). In addition, in certain embodiments, a more advanced method may be to use a hyperspectral camera, which shows the full spectrum of thermal emission at each wavelength. With this information, a more accurate radiative transfer model may be used by the DCS 24 to compensate for atmospheric absorption and scattering. These cameras may also allow for the estimation of flare size, which may also provide additional information to be used by the DCS 24.

As described in greater detail herein, in addition to the ground-based measurement techniques to determine average flare flame temperature or its radiant heat output, satellite-based detection platforms 26 may also be utilized. There are multiple satellite data sources, which have been considered to detect flares 14 and estimate flaring-related measurements such as radiant heat. One method utilizes the Advanced Along Track Scanning Radiometer (AATSR) instrument series on the Envisat satellite. In such an embodiment, an algorithm may detect flares 14 using night-time short wavelength infrared (IR) measurements assuming the background contributions of night-time total radiation measured by the AATSR instrument to be negligible. Another method utilizes the Sea and Land Surface Temperature Radiometer (SLSTR) on board the Copernicus satellite Sentinel-3A. In such an embodiment, measurements from SLSTR may be used by the DCS 24 to calculate flared gas volumes and black carbon emissions utilizing filters based on hot spot characteristics. Another method that includes a consumable data product to calculate radiant heat involving night-time detection of flares 14 using multi-spectral imaging developed by the Colorado School of Mines. In such an embodiment, the Visual-Infrared Imaging Radiometer Suite (VIIRS) sensor on Suomi NPP and NOAA-20 satellites may be used to provide near-IR data captured in different channels, which may be processed to detect combustion sources and post-processing steps may be conducted to eliminate noise. Plank curve fitting may be performed to estimate derived measurements such as temperature of background and hot sources as well as radiant heat. The two main considerations for remote sensing with satellites is a low minimum detection threshold to detect smaller flares 14 and an accurate method of using flare brightness to estimate flare gas volume and radiant heat.

Figure 10:
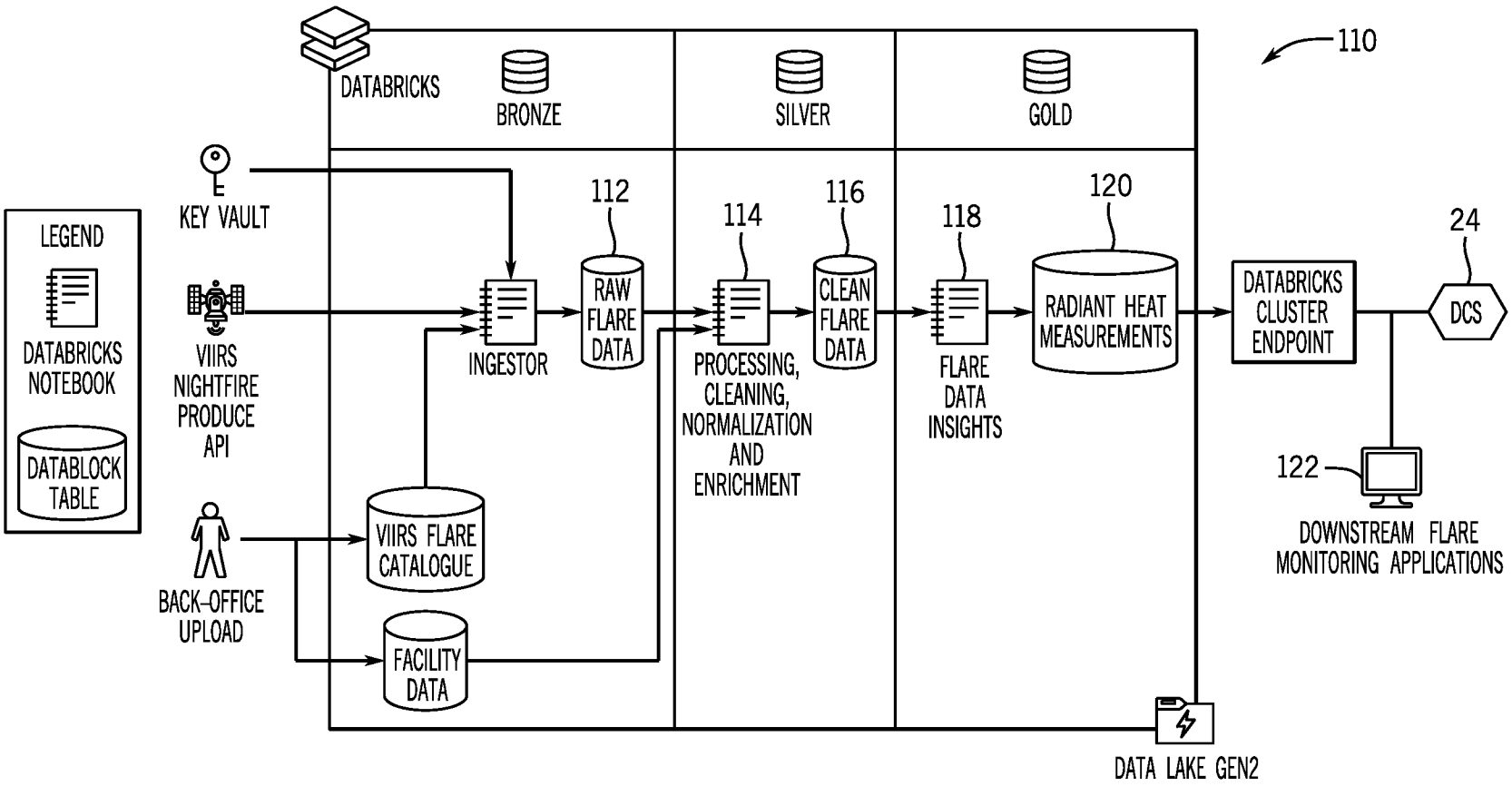
FIG. 10 illustrates an example workflow for extracting radiant heat measurements from the VIIRS Nightfire Product from Colorado School of Mines.

FIG. 10 illustrates an example workflow 110 for extracting radiant heat measurements from the VIIRS Nightfire Product from Colorado School of Mines. The workflow 110 illustrated in FIG. 10 may collect raw flare data 112, which may be processed, cleaned, normalized, and enriched 114 to create clean flare data 116, which may be used to generate flare data insights 118, which may be used to generate radiant heat measurements 120 that may be used by the DCS 24 and/or other downstream flare monitoring applications 122 to determine the flaring efficiency, as described in greater detail herein. The workflow 110 illustrated in FIG. 10 is merely exemplary of the types of flare data processing steps that may be performed, and other combinations of data processing steps may be performed in other embodiments.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

In the claims, means-plus-function clauses are intended to cover the structures described herein as performing the recited function and not only structural equivalents, but also equivalent structures. Thus, for example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A flare monitoring system, comprising:

a flaring system of an oil and gas worksite comprising a flare configured to combust a flare gas at a tip of the flare;

one or more flare monitors configured to detect radiant or thermal heat generated by the combustion of the flare gas at the tip of the flare; and a control system configured to:

determine a flaring efficiency of the combustion of the flare gas at the tip of the flare based at least in part on the detected radiant or thermal heat;

determine a measured flaring temperature of the combustion of the flare gas at the tip of the flare based at least in part on the radiant or thermal heat detected by the one or more flare monitors;

determine a theoretical flaring temperature of the combustion of the flare gas at the tip of the flare based at least in part on parameters of the flaring system using a simulation model of the flaring system;

determine the flaring efficiency of the combustion of the flare gas at the tip of the flare by comparing the measured flaring temperature to the theoretical flaring temperature;

iteratively adjust a first theoretical fraction of the flare gas that is combusted at the tip of the flare and a second theoretical fraction of the flare gas that is not combusted at the tip of the flare based on the comparison of the measured flaring temperature to the theoretical flaring temperature; and iteratively determine the theoretical flaring temperature of the combustion of the flare gas at the tip of the flare based at least in part on the first and second theoretical fractions of the flare gas.

2. The flare monitoring system of claim 1, wherein the control system is configured to automatically adjust the parameters of the flaring system based at least in part on the determined flaring efficiency.

3. The flare monitoring system of claim 1, wherein a flare monitor of the one or more flare monitors is located at or near a surface of the oil and gas worksite.

4. The flare monitoring system of claim 3, comprising a mobile robot configured to maneuver the flare monitor relative to the oil and gas worksite.

5. The flare monitoring system of claim 1, comprising a drone, airplane, or helicopter configured to fly above the oil and gas worksite to maneuver a flare monitor of the one or more flare monitors relative to the oil and gas worksite.

6. The flare monitoring system of claim 1, wherein the one or more flare monitors comprise a satellite-based flare monitor.

7. The flare monitoring system of claim 1, wherein the one or more flare monitors comprise a temperature probe configured to directly detect the radiant or thermal heat generated by the combustion of the flare gas at the tip of the flare.

8. The flare monitoring system of claim 1, wherein the one or more flare monitors comprise a blackened absorber configured to detect radiant heat flux generated by the combustion of the flare gas at the tip of the flare.

9. The flare monitoring system of claim 1, wherein the one or more flare monitors comprise a thermal camera configured to capture thermal images of the tip of the flare, and wherein the control system is configured to determine the radiant or thermal heat of the combustion of the flare gas at the tip of the flare based at least in part on analysis of the thermal images.

10. A method, comprising:

detecting, via one or more flare monitors, radiant or thermal heat generated by combustion of a flare gas at a tip of a flare of a flaring system of an oil and gas worksite;

determining, via a control system, a flaring efficiency of the combustion of the flare gas at the tip of the flare based at least in part on the detected radiant or thermal heat;

determining, via the control system, a measured flaring temperature of the combustion of the flare gas at the tip of the flare based at least in part on the radiant or thermal heat detected by the one or more flare monitors;

determining, via the control system, a theoretical flaring temperature of the combustion of the flare gas at the tip of the flare based at least in part on parameters of the flaring system using a simulation model of the flaring system;

determining, via the control system, the flaring efficiency of the combustion of the flare gas at the tip of the flare by comparing the measured flaring temperature to the theoretical flaring temperature;

iteratively adjusting, via the control system, a first theoretical fraction of the flare gas that is combusted at the tip of the flare and a second theoretical fraction of the flare gas that is not combusted at the tip of the flare based on the comparison of the measured flaring temperature to the theoretical flaring temperature; and iteratively determining, via the control system, the theoretical flaring temperature of the combustion of the flare gas at the tip of the flare based at least in part on the first and second theoretical fractions of the flare gas.

11. The method of claim 10, comprising automatically adjusting, via the control system, the parameters of the flaring system based at least in part on the determined flaring efficiency.

12. The method of claim 10, comprising maneuvering, via a drone, airplane, or helicopter, a flare monitor of the one or more flare monitors relative to the oil and gas worksite.

13. The method of claim 10, wherein the one or more flare monitors comprise a satellite-based flare monitor.

14. The method of claim 10, comprising:

capturing, via a thermal camera, thermal images of the tip of the flare; and determining, via the control system, the radiant or thermal heat of the combustion of the flare gas at the tip of the flare based at least in part on analysis of the thermal images.

* * * * *